United States Patent [19]

Golicz

[11] Patent Number: 5,072,921

[45] **Date of Patent: * Dec. 17, 1991**

[54] FEEDING MECHANISM

[75] Inventor: Roman M. Golicz, Clinton, Conn.

[73] Assignee: GBR Systems Corporation, Chester, Conn.

[ * ] Notice: The portion of the term of this patent subsequent to Sep. 20, 2005 has been disclaimed.

[21] Appl. No.: 527,303

[22] Filed: May 23, 1990

Related U.S. Application Data

[63] Continuation of Ser. No. 245,220, Sep. 16, 1988, abandoned, Continuation of Ser. No. 863,372, May 15, 1986, Pat. No. 4,772,004.

[51] Int. Cl.[5] ..... B65H 3/04

[52] U.S. Cl. ..... 271/35; 271/157; 271/161

[58] Field of Search ..... 271/34, 35, 10, 161, 271/3.1, 157

[56] References Cited

U.S. PATENT DOCUMENTS

| | | | |
|---|---|---|---|
| 3,027,161 | 3/1962 | Solyst | 271/10 |
| 3,485,489 | 12/1969 | Lindquist | 271/34 X |
| 3,645,012 | 2/1972 | Fiehler | 271/35 X |

*Primary Examiner*—Richard A. Schacher

*Attorney, Agent, or Firm*—Stoll, Previto & Hoffman

[57] ABSTRACT

A mechanism for feeding sheets having a feed belt on front and rear rollers. A singulator assembly overlying and in contact with the feed belt. An auxiliary roller interposed between said front and rear rollers, with the singulation assembly in contact with the feed belt at a point between the front roller and the auxiliary roller. The singulator having a pair of spaced side frame members, central pressure roller between the spaced frame members, a roller rotatably mounted on each end of the frame members, and a belt surrounding the rollers and the central pressure roller, so that sheets on said feed belt are fed one by one between the singulator assembly and the feed belt.

18 Claims, 2 Drawing Sheets

FEEDING MECHANISM

This application is a continuation of U.S. patent application Ser. No. 07/245,220 filed Sept. 16, 1988, now abandoned, which, in turn, was a continuation of U.S. patent application Ser. No. 863,372 filed May 15, 1986, now U.S. Pat. No. 4,772,004 dated Sept. 20, 1988.

BACKGROUND OF THE INVENTION

The present invention is directed to a feeding mechanism and, more particularly, to a feeding mechanism to feed, in sequence, variable number of sheets to a holding station and, upon receipt of a signal, to release the accumulated stack of sheets to subsequent processes, such as collating, inserting and the like.

Some known feeding mechanisms have a number of drawbacks including the fact that the operator needs special training and the fact that constant operator intervention and attention are required. Another drawback of certain feeders is the fact that numerous adjustments are necessary for variations in paper size, thickness, texture and configuration. In addition, existing feeders lack dynamic reading, matching and counting as well as the assurance of reliable singulation regardless of thickness, size, fold and texture. Furthermore, double feed detection and control of same, as well as reliable justification of pages to leading edge and one side edge are inaccurate in existing feeders. Moreover, over or under stacking and accumulation of fed pages into orderly and precisely superimposed and justified stack, as well as release of the stack without loss of justification to subsequent operation, are unreliable in some existing feeders.

BRIEF DESCRIPTION OF THE INVENTION

The present invention overcomes these defects and has for one of its objects the provision of an improved feeder which requires minimum operator intervention, attention and training.

Another object of the present invention is to provide an improved feeder which requires minimum adjustments and which accepts variations in paper size, thickness, texture and configuration.

Another object of the present invention is to provide an improved feeder which assures reliable singulation regardless of thickness, size, fold and texture.

Other and further objects of the invention will be obvious upon an understanding of the illustrative embodiment about to be described, or will be indicated in the appended claims and various advantages not referred to herein will occur to one skilled in the art upon employment of the invention in practice.

In order to achieve the above, a supply conveyor is provided which is designed to limit the time the operator had to spend on tending the machine which normally consists of supplying the machine with processing material. This supply conveyor consists of motorized conveyor controlled by the feeder mechanism which, upon demand, resupplies the feeder with adequate amounts of paper to ensure reliable and continuous feed. Any potential problems are self correcting and the ones that do occur are detected and displayed to facilitate correction. To overcome that requirement for a substantial amount of manual dexterity in loading of the supply hoppers, the conveyor of this system accepts large volume of stock without the necessity of precise positioning thereby permitting infrequent loading. The feeder includes a singulating device which has been designed to accomplish final "shingling" to facilitate reliable singulation and feeding. Easy access to work and potential problem areas facilitates ease of problem elimination, recycling of and rereading of misfed or misstacked sheets and eliminates destruction of documents.

To permit acceptance of variations in size, configuration, thickness and texture, the feed and singulation device has been conceived as a single, interacting system. The interaction between the two assures that the feed rate is inversely proportional to singulation. Hence, if more than one sheet tends to be fed, the singulation forces increase while feed is being reduced and vice versa. The above is achieved through automatic change in geometry of the feed path and tension in feed belt as well as singulating function area.

BRIEF DESCRIPTION OF THE DRAWING

A preferred embodiment of the invention has been chosen for purposes of illustration and description and is shown in the accompanying drawings forming a part of the specification, wherein.

DESCRIPTION OF THE INVENTION

Figure 1:
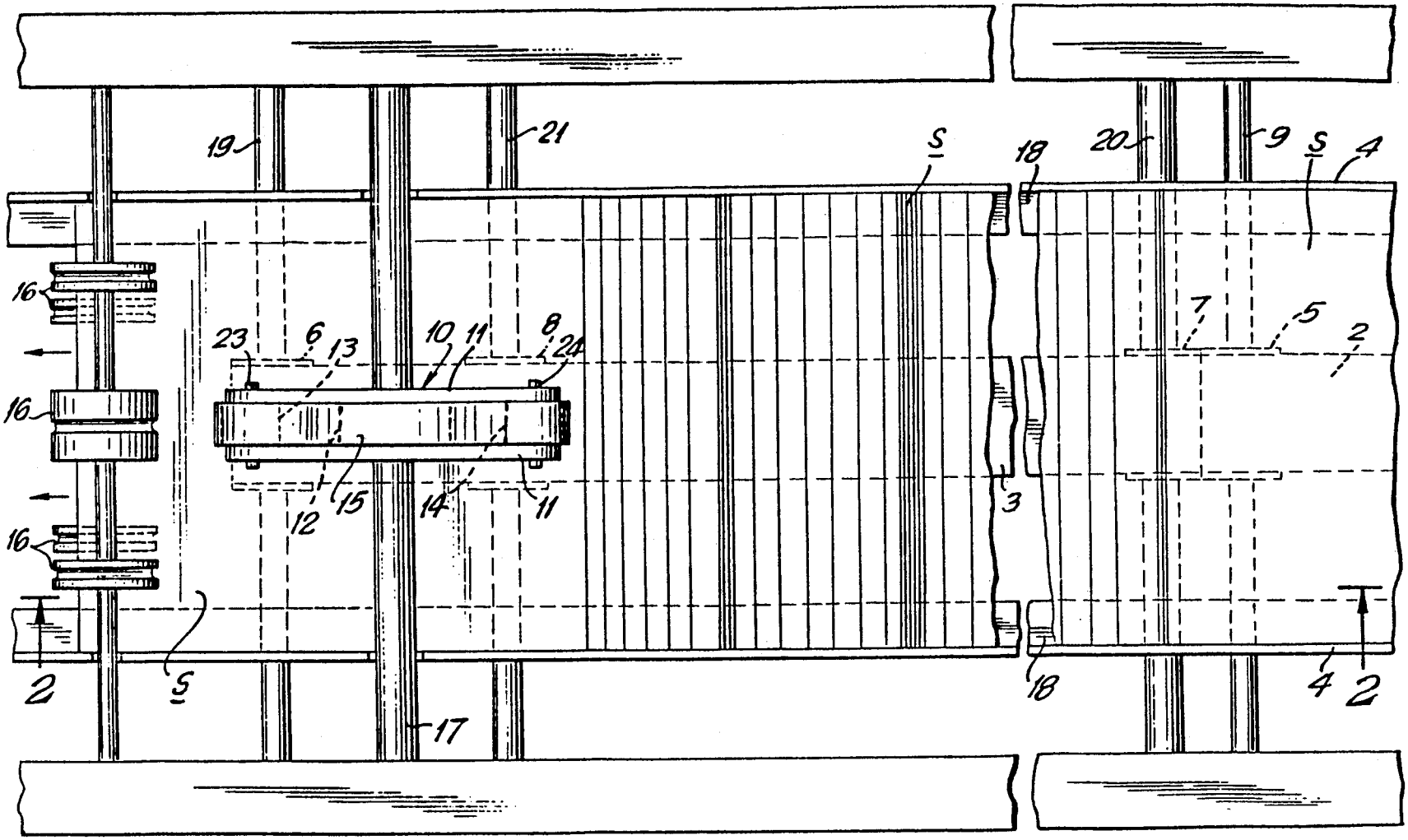
FIG. 1 is a top plan view of the feeder mechanism embodying the present invention.

The improved feeder mechanism of the present invention comprises a frame 1 having a pair of endless conveyor and feed belts 2 and 3, respectively. Conveyor belt 2 is advanced by roller 5 on shaft 9 to feed a stack of sheets S to the feed belt 3 which is below the plane of the conveyor belt 2. The sheets S are confined to a predetermined path by means of opposed side walls 4 which are provided with edge supports 18. The feed belt 3 comprises a front drive feed roller 6 and a rear idle roller 7, mounted on front and rear shafts 19 and 20, respectively. An auxiliary roller 8 mounted on an auxiliary shaft 21 is interposed between rollers 6 and 7 for a purpose which will be more fully discussed hereinbelow. The rear shaft 20 is rotatable around offset pin 22 to permit the tension on feed belt 3 to be adjusted.

Mounted above the feed belt 3 and between the auxiliary roller 8 and the front drive roller 6 is a singulator feeder assembly 10. The singulator assembly 10 comprises a pair of opposed frame members 11 having a stationary central singulation member 12 preferably in the form of a wheel, mounted on a rotatable singulator shaft 17 which is keyed to frame members 11 and roller 12. At each end of the frame members 11 there is provided rotatable front and rear singulation rollers 13 and 14, respectively, mounted on shafts 23 and 24, respectively, which are journaled in the frame elements 11. A narrow continuous singulation belt 15 extends over the wheel and rollers 12, 13 and 14. The rollers 13 and 14 are of lesser diameter than the central wheel 12 so that the singulation belt 15 assumes the generally diamond-shaped configuration shown in FIG. 2. The singulator belt 15 is in contact with the feed belt 3 between the front feed roller 6 and the auxiliary roller 8 and is adapted to apply pressure thereto.

The sheets S are fed one by one in a manner more fully discussed hereinbelow. The feed belt 2 pushes the sheets S against the singulator belt 15 of the singulation assembly 10 to form an inclined shingling area A in the space between feed belt 3 and the singulator belt 15. The sheets S are then moved one by one beneath the singulation belt 15 from the bottom of the shingling area A and as each sheet S is fed, it is moved by a plurality of pull-out rollers 16.

Feeding of sheets S is accomplished through means of the belt 15 which is preferably a single elastomeric, reinforced belt of appropriate width and surface material. The belt 15 is appropriately tensioned between drive and idler rollers 6 and 7 with front drive roller 6 being actuated by means of high torque overrunning clutch (not shown) and the rear roller 7 acting as an idler roller and a belt tensioning device through shaft 20. The stream of sheets S is fed on demand, from the conveyor belt 2 onto the feed belt 3.

Since the coefficient of friction between belt 15 and the lower most sheet S is greater than the coefficient of friction between subsequent sheets and since the subsequent sheets S are restrained in shingling area A, only the lower most sheet S will be fed. To control restrainment of the subsequent sheets S in shingling area A and yet to allow the necessary freedom to feed sheets S regardless of thickness variation, the singulator wheel 12 is placed a predetermined distance away from the front feed roller 6 to allow the feed belt 3 to flex away from the singulator wheel 12 as each sheet S passes therebetween.

However, since the driving force of the feed belt 3 must overcome the braking force and weight of the restrained stack resting in the shingling area A, and since the singulation wheel 12 forces the lower surface of the singulator belt 15 below the pull line of the feed belt 3, there are developed a number of forces, some of which push against the belt 15 and the balance of which will comprise the feeding force. To limit the ratio of these forces, the auxiliary roller 8 is provided below the feed belt 3 at a given distance behind the singulating assembly 10 to limit the amount of downward deflection of the feed belt 3. The required amount of "slack" is controlled through belt tension adjustment shaft 20.

The singulator assembly 10 may be adjusted to control the feeding of the sheets 10. It may be raised or lowered vertically by raising or lowering the shaft 17 so as to allow greater or lesser pressure to be applied to feed belt 3. In addition, singulation assembly 10 may be pivoted around the central shaft 17 so that the configuration of the shingling area A may be adjusted. Furthermore, the singulation assembly 10 may be moved in a horizontal plane by moving the shaft 17 in a horizontal plane to adjust the position of singulation assembly 10 relative to the feed rollers 6 and auxiliary roller 8.

Figure 2:
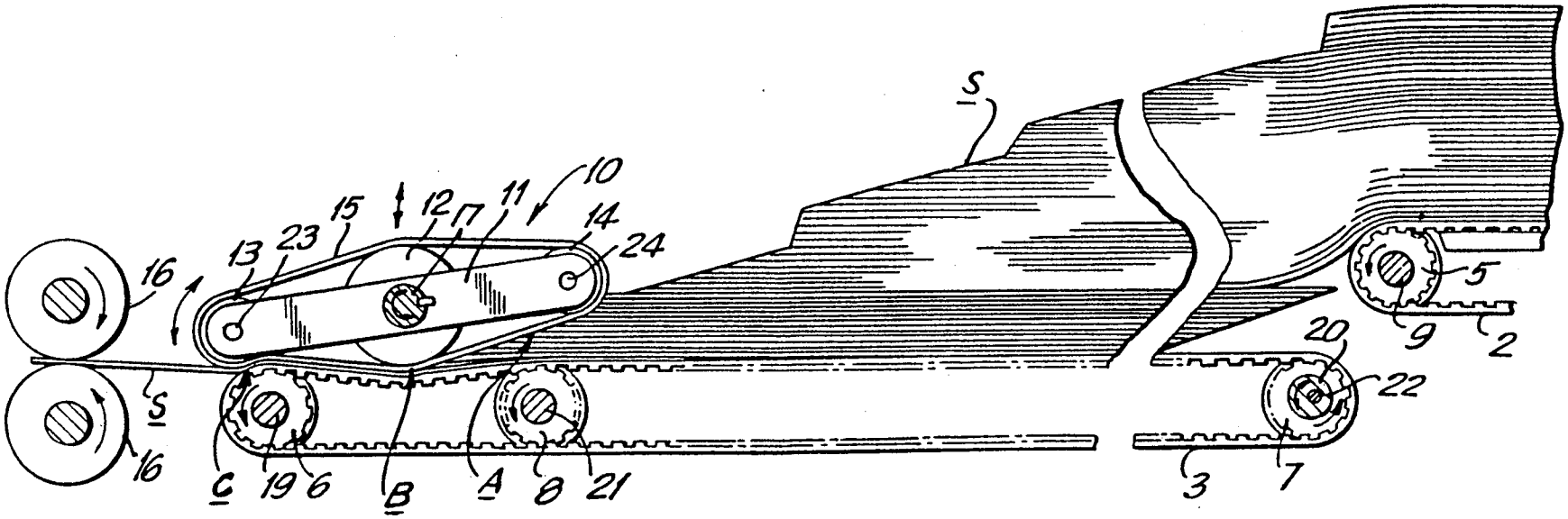
FIG. 2 is a sectional view taken along line 2—2 of FIG. 1.

The control of primary singulation is achieved at point B on FIG. 2 through lowering or raising of the singulator shaft 17, hence, the deflection of the feed belt 3 and feed belt tension between drive and idler rollers 6 and 8, respectively. Subsequent singulation is achieved through appropriate amount of rotation of the singulator shaft 17 with tilting of the entire singulating assembly 10. This lays the singulator belt 15 over the feed belt 3 and since the singulator front roller 13 projects beyond the center line of the feed roller 19, it permits partial overwrap of the singulator belt 15, thus creating a reverse singulating action at area C. By reverse singulation is meant that while in the primary singulation area B, the lower most sheet S has to travel the longest distance, since the stream of paper in shingled position A is wrapped over the subsequent sheets and over the singulating belt 15 in the final reverse singulating area C, the overwrap is reversed when the lower most sheet and subsequent sheets are forced to wrap over the feed belt 3. Hence, the lower most sheet must travel the shortest distance while the leading edges of subsequent sheets are exposed to and must overcome the additional friction of the singulating belt 15.

As previously described, self-compensating features of the singulating concept and mechanism, namely, the tendency of the feed belt to seek straight line when pulled, assures that various intermixed stacks of different thicknesses, porosities, textures or even materials will singulate, with only minimal adjustments.

It will thus be seen that the present invention provides an improved feeder which requires minimum operator intervention, attention and training and minimum adjustments and which accepts variations in paper size, thickness, texture and configuration. The improved feeder also provides assurance of reliable singulation regardless of thickness, size, fold and texture.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for feeding sheets from a stack of sheets, each sheet of which has front, rear and a pair of side edges, said stack of sheets having at least one end sheet, comprising feed means and a singulator assembly in operative juxtaposition to said feed means, said feed means feeding sheets from said stack one by one between said singulator assembly and said feed means, said sheets passing between said feed means and said singulator assembly in a linear direction parallel to the side edges of each sheet, said feed means in contact with each sheet as it passes thereby, said singulator assembly in contact with and applying pressure to each sheet as it passes thereby, said feed means comprising at least one endless belt having a wide, flat, planar and uninterrupted contact surface which will come into contact with each of said sheets, the end sheet of said stack bearing against and resting on the endless belt of the feed means, the sheet in contact with the feed means being the said end sheet of the stack which rests on said endless belt, and being the sheet fed by said feed sheet, said singulator assembly comprising an endless belt having a wide, flat, planar and uninterrupted contact surface which will come into contact with each of said sheets both of said belts being oriented in said linear direction whereby each sheet is bowed as each sheet passes between the said two belts, each sheet being on a predetermined plane before it passes said singulator assembly, and the plane of each sheet after it passes said singulator assembly being substantially parallel to said predetermined plane.

2. A mechanism as claimed in claim 1 wherein said feed means comprises a feed belt having front and rear rollers, an auxiliary roller is interposed between said front and rear rollers, and wherein said singulation assembly is in contact with said feed belt at a point between said front roller and said auxiliary roller.

3. A mechanism as set forth in claim 2 wherein said front roller is a drive roller and said rear roller is an idler roller.

4. A mechanism as set forth in claim 3 wherein said auxiliary roller is closer to said front roller than said rear roller.

5. A mechanism as set forth in claim 4 wherein said rear roller has means for tensioning said feed belt.

6. A mechanism as set forth in claim 5 wherein said rear roller has an offset shaft to permit tensioning.

7. A mechanism as set forth in claim 6 wherein a conveyor feeds sheets to said feed belt.

8. A mechanism as set forth in claim 7 wherein a stack of sheets on said feed belt assumes an inclined position in a shingling area formed between the singulator assembly and the feed roller.

9. A mechanism as set forth in claim 8 wherein said singulator assembly is vertically moveable.

10. A mechanism as set forth in claim 9 wherein said singulator is tiltable whereby the shingling area may be adjusted.

11. A mechanism as set forth in claim 10 wherein said singulator assembly comprises a pair of spaced frame members, central pressure means interposed between said spaced frame members, a roller rotatably mounted on each end of each frame member, and a belt surrounding said rollers and said central pressure means.

12. A mechanism as set forth in claim 11 wherein said central pressure means comprises a central wheel.

13. A mechanism as set forth in claim 12 wherein the central wheel is of greater diameter than the said end rollers.

14. A mechanism as set forth in claim 13 wherein each end roller is rotatably journaled in the end of the side frame members.

15. A mechanism as set forth in claim 14 wherein the central wheel is stationary.

16. A mechanism as set forth in claim 15 wherein the central wheel is operatively attached to the side frame members.

17. A mechanism as set forth in claim 16 wherein shaft means are provided to tilt the said frame members therearound.

18. A mechanism as set forth in claim 17 wherein said shaft and said central wheel is adjustable for movement in any horizontal or vertical direction.

* * * * *